US006725767B1

(12) United States Patent
Toner

(10) Patent No.: US 6,725,767 B1
(45) Date of Patent: Apr. 27, 2004

(54) PRESSING ASSEMBLY AND METHOD OF LOADING A PRESS

(75) Inventor: Michael Toner, Napier (NZ)

(73) Assignee: GRM Distributors Limited, Hastings (NZ)

( * ) Notice: Subject to any disclaimer, the term of this patent is extended or adjusted under 35 U.S.C. 154(b) by 0 days.

(21) Appl. No.: 09/937,026

(22) PCT Filed: Mar. 23, 2000

(86) PCT No.: PCT/NZ00/00036

§ 371 (c)(1),
(2), (4) Date: Sep. 19, 2001

(87) PCT Pub. No.: WO00/56532

PCT Pub. Date: Sep. 28, 2000

(51) Int. Cl.[7] ..... B30B 13/00

(52) U.S. Cl. ..... 100/35; 100/207; 100/215; 100/218

(58) Field of Search ..... 100/35, 138, 218, 100/215, 196, 207; 414/277; 72/405.07, 405.01

(56) References Cited

U.S. PATENT DOCUMENTS 3,948,162 A * 4/1976 Numba ..... 100/45
4,292,892 A * 10/1981 Combs ..... 100/218
4,348,144 A * 9/1982 Nelson ..... 414/277
5,749,290 A * 5/1998 Johnson et al. ..... 100/207
5,826,501 A * 10/1998 Gjervaldsater ..... 100/196
5,938,400 A 8/1999 Massmann et al.

FOREIGN PATENT DOCUMENTS

DE 4204674 C 6/1993
WO WO 99/25543 A 5/1999

* cited by examiner

*Primary Examiner*—Allen Ostrager
*Assistant Examiner*—Shelley Self
(74) *Attorney, Agent, or Firm*—Workman Nydegger

(57) ABSTRACT

A pressing assembly (10) includes a press (12) being moveable from an open configuration to an operable configuration to compress an object (16). A loader (14) is also provided having one or more first pushers (42) moveable into a region within the press (12) to load the object (16) into a pressing zone within the press (12). The arrangement is such that the or each pusher (42) is clear of the pressing zone once the press (12) is in the operable configuration. The or each pusher (42) may be provided on a reciprocable pusher assembly (36) which is moveable in a forward and a reverse direction. In the forward direction of the reciprocable pusher assembly, the first pusher (42) pushes the object into a pressing zone in the press. A second pusher (44) is also moveable with the pusher assembly (36) for ejecting another of said objects from the pressing zone on forward movement of the pusher assembly (36) wherein, in the reverse direction of the pusher assembly, the second pusher (44) is moveable relative to the pusher assembly (36) to retract beyond the object loaded into the pressing zone.

40 Claims, 3 Drawing Sheets

PRESSING ASSEMBLY AND METHOD OF LOADING A PRESS

FIELD OF THE INVENTION

The present invention relates to a pressing assembly. In particular, although not exclusively, the invention relates to a pressing assembly which includes a loading/unloading means to convey bales into a column-type press. However, the invention is not restricted in its use for conveying bales into a press and may indeed be adapted or applied to convey any type of object into any type of press.

BACKGROUND TO THE INVENTION

Conventional presses used for pressing bales are column-type presses. These presses include two opposing platens moveable relative to one another to press a bale between the opposing faces of the platens. A number of columns extend between the two platens, the number usually being four with the columns symmetrically arranged on either side of the press. The considerable stresses associated with the pressing force are transferred through the columns. Therefore the bale should be presented accurately to the press. Any misalignment could cause serious imbalance to the columns, the likely result being cracking of the press columns or the frame of the press.

Conventionally, bales are presented to the press by an endless belt conveyer. The belt runs over the top of one of the platens defining the press table and down through an opening under the table. The inherit difficulty with this arrangement is that as a bale is compressed by the press, this action tends to stretch the belt and so cause rapid wearing of the belt. If the belt joint should lie within the press during pressing, considerable stress will be placed on the joint. This leads to inevitable breaking of the belt involving substantial down time while a new belt is fitted and tracked.

It is therefore an object of the present invention to provide a pressing assembly and/or a method of pressing which overcomes or ameliorates the disadvantages referred to above or provides the public with a useful choice.

SUMMARY OF THE INVENTION

In accordance with a broad aspect of the present invention there is provided a pressing assembly including a press being moveable from an open configuration to an operable configuration to compress an object, and a loading means having one or more pushers moveable into a region within the press to load the object to a pressing zone within the press, the arrangement being such that the or each pusher is clear of the pressing zone once the press is in the operable configuration.

Preferably there are two pushers arranged to act on opposite sides of the object. The pushers may be retractable to move past a subsequent object to be loaded. Preferably the assembly also includes ejection means.

In accordance with a second aspect of the present invention there is provided a pressing assembly including a press for pressing objects, a loading/unloading means for loading objects into and out of the press, the loading means including a reciprocable pusher assembly moveable in a forward and a reverse direction, the pusher assembly having a first pusher moveable with the pusher assembly for loading one of said objects to a pressing zone in the press on forward movement of the pusher assembly, a second pusher moveable with the pusher assembly for ejecting another of said objects from the pressing zone on forward movement of the pusher assembly wherein, in the reverse direction of the pusher assembly, the second pusher is moveable to retract beyond the object loaded into the pressing zone.

Preferably the reciprocal pusher assembly includes a linkage enabling the first and second pushers to move in unison. It is preferred that the linkage is a rail. This construction enables the rail to slide linearly along a support frame. The linkage, eg the rail, with the first and second pushers may be disposed to the side of the path of objects being loaded into the press.

Suitably the reciprocal pusher assembly is such to load objects one by one into the press. Alternatively, bundles or groups of objects may be loaded into the press although the preferred intended application is for use with pulp bales.

In a most preferred form of the invention there are two rails disposed on either side of the path of the objects being loaded into the press, each including first and second pushers. It is preferred that the two rails are joined so as to move in unison thereby defining a moveable carriage. This enables the carriage to be reciprocated by a single reciprocating means such as an hydraulic cylinder.

As mentioned above, the preferred means of moving the reciprocable pusher assembly is by an hydraulic cylinder. However, other arrangements eg using cams, rack and pinion are also considered within the scope of the present invention.

As mentioned above, the reciprocable pusher assembly may be slidable relative to a support frame. In a preferred form of the invention this includes a track with gliders extending from the reciprocable pusher assembly received within the track. The support frame may be erected independently next to the press. Alternatively, one end of the support frame may be supported by the press.

Preferably, the press includes opposing horizontal platens moveable relative to one another. Suitably, but not exclusively, one platen is stationary while the other moves. The base of the objects it transverses the path through the loading/unloading means towards the press defines a loading plane. Preferably, the stationary platen is level with the loading plane. Suitably, the press operates to close in a direction orthogonal to the loading plane. The press is preferably a column type press.

Suitably, the reciprocable pusher assembly is such that it does not interfere with the operation of the press during the closing of the platens. The reciprocable pusher assembly may be completely free of the platens prior to any closing of the press. Alternatively, the press may operate to initially apply a minimal pressure to the object within the press to thereby hold the object in the pressing zone so as to minimise the possibility of movement when the reciprocable pusher assembly is moved in the reverse direction. The reciprocable pusher assembly may move into the space between the opposing platens once the platens have opened sufficiently to enable a subsequent object to be loaded into the press. Alternatively, the reciprocable pusher assembly may be completely free of the press until the platens are fully open.

The second pusher operating as an ejection pusher may be pivotable. In an alternative form of the invention, the second pusher may simply reciprocate for example at 90° to the direction of movement of the reciprocable pusher assembly. For example, a reciprocable pusher may include a curved surface which, when making contact with an object in the pressing zone cause the pusher to retract inwardly. As another alternative, rollers may be incorporated to assist with retraction of the second pusher.

In a most preferred form of the invention, there are two second pushers on either side of the path of the objects moving towards the press each being elongate in the form of fingers.

Preferably, the second ejection pushers are biased to return to the unretracted configuration once past the pressing zone to return the second pushers to a configuration adapted to eject an object from the press. A spring may form a suitable bias to the second pusher.

The pusher may be moveable to retract out of the pressing zone by simple contact with the object in the pressing zone. For this reason, it is preferred that the biasing means biasing the second pusher to the unretracted configuration has a lesser effect than the force resisting movement of the object from the pressing zone. This will ensure that the second pusher does not inadvertently disturb the object in the pressing zone on its reverse movement with the reciprocable pusher assembly. In an alternative form of the invention, the second pusher may be tripped to automatically retract when moving past the pressing zone.

Preferably the first pusher moves an object from a loading zone to the pressing zone. In a similar fashion to the second pusher, the first pusher may be moveable relative to the reciprocable pusher assembly during the reverse direction of the pusher assembly, to retract beyond the loading zone. The first pusher may therefore possess any of the features described above in connection with the second pusher.

The pressing assembly further includes a conveying means to convey objects to the loading zone. The conveying means may be aligned with the loading plane along which the objects move on their path to the press. In an alternative form of the invention, the conveying means may convey the objects from above or below or from either side. Preferably the conveying means is a belt conveyer.

In accordance with a third broad aspect of the present invention there is provided a method of loading objects into a press having two opposing platens, the method including using one or more pushers to load the object to a pressing zone within the press whereby the pushers are clear of the pressing zone once the press operates to compress the object.

In accordance with a fourth aspect of the present invention there is provided a method of loading/unloading objects into a press, the method including using a reciprocable pusher assembly having first and second pushers, moving the reciprocable pusher assembly in a forward direction to simultaneously move both the first and second pushers such that the first pusher moves one of said objects to a pressing zone in the press and the second pusher ejects another of said objects from the press, moving the reciprocable pusher assembly in a reverse direction to simultaneously move both the first and second pushers wherein the second pusher also moves to retract beyond the pressing zone.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples only.

BRIEF SUMMARY OF THE DRAWING

In order that the invention may be more fully understood, one embodiment will now be described by way of example with reference to the following drawings in which.

BEST MODE FOR CARRYING OUT THE INVENTION

Figure 1:
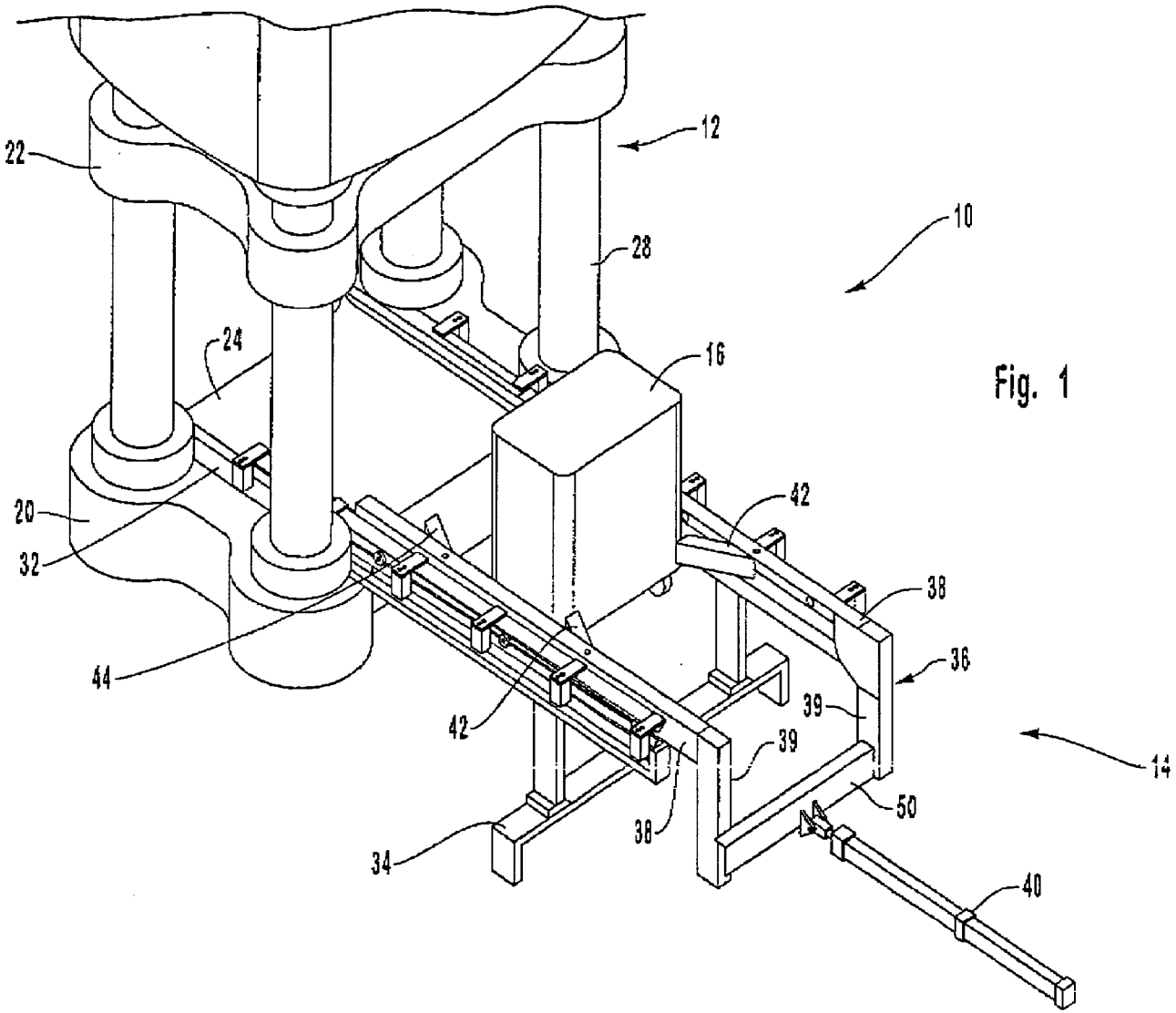
FIG. 1 is a perspective view of a pressing assembly in accordance with a preferred embodiment of the present invention.

As shown in FIG. 1, the pressing assembly 10 includes a press 12 and a loading/unloading means 14 for loading and unloading objects 16 into and out of the press 12. The objects 16 travel over a support surface which could be in the form of a metal plate (not shown).

The press 12 comprises opposing platens 20, 22, one of which is stationary to define a pressing surface or press table 24. The other platen is moveable to compress an object 16 placed between the opposing platens 20, 22. The moveable platen 22 slides relative to the four columns 28 of the press 12, there being two columns one each side of the press 12.

Figure 3:
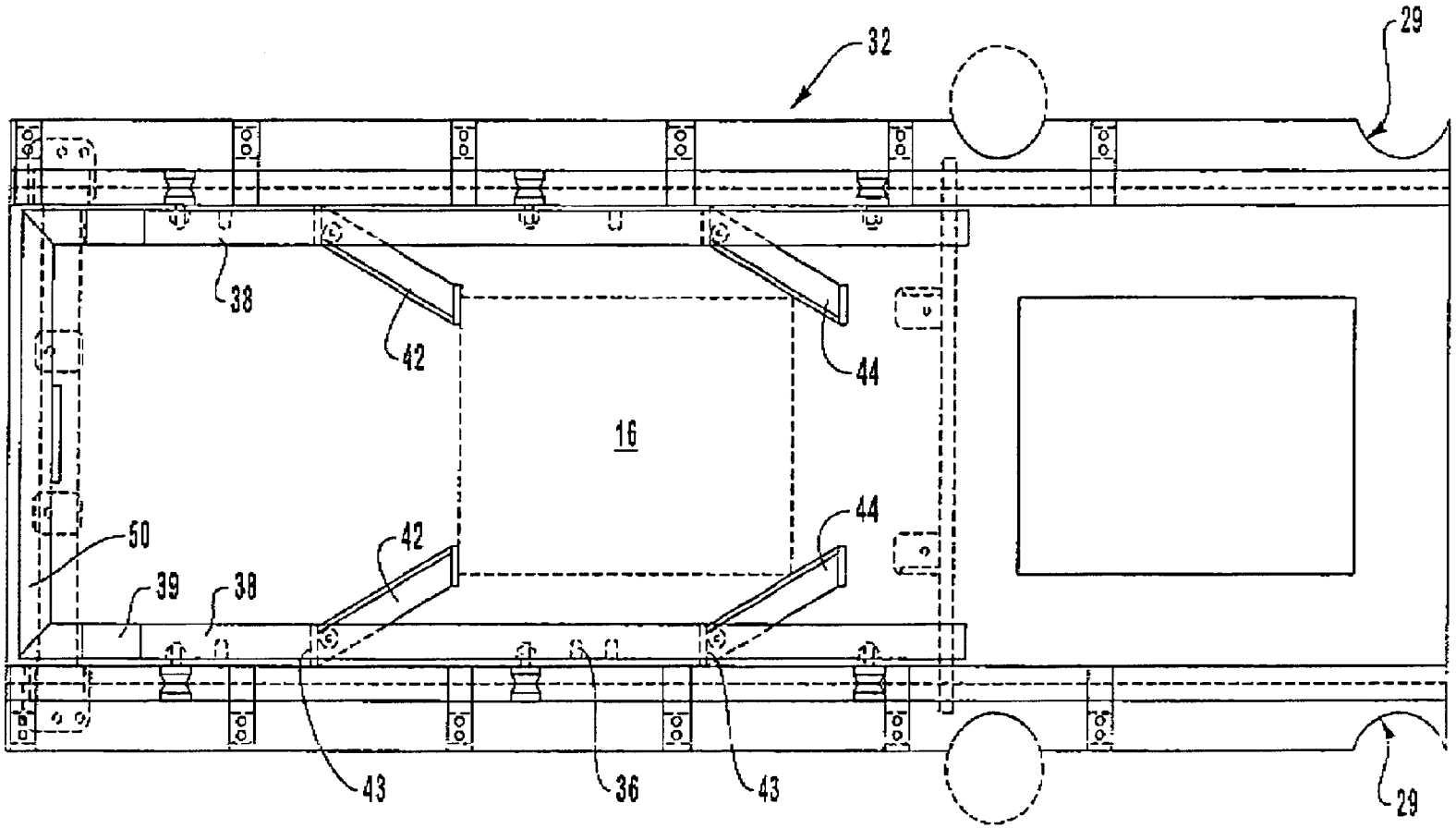
FIG. 3 is a plan view of the pressing assembly shown in FIG. 1.

The press table 24 supports one end of a support frame 32 forming part of the loading/unloading means 14. As shown in FIG. 3, the support frame 32 is shaped with four circular recess 29, each to receive a column 28 of the press 12. This enables the support frame 32 to fit within the press 12. The support frame 32 is supported at the other end by upright support 34. The support frame 32 provides a guide for a reciprocable pusher assembly in the form of a slidable carriage 36 reciprocated back and forth along the frame by a hydraulic cylinder 40. The cylinder 40 is powered by a simple powerpack (not shown) incorporating a pump, directional control valve and a relief valve. In another preferred form of the invention, the carriage may be driven by a vari-speed electric motor, connected to the carriage by a chain drive.

The slidable carriage 36 is defined by a pair of spaced rails 38 and by respective uprights 39 joined at their ends to respective outer ends of the rails 38, as well as a cross bar 50 joining the opposite ends of the uprights 39. Each of the spaced, parallel rails 38 are supported by respective sides of the support frame. The rails 38 which are substantially horizontal as shown are slidable relative to the respective sides of the support frame 32. It will be apparent that the rails 38 are slidable into the region defined by the two opposing platens of the press.

Figure 2:
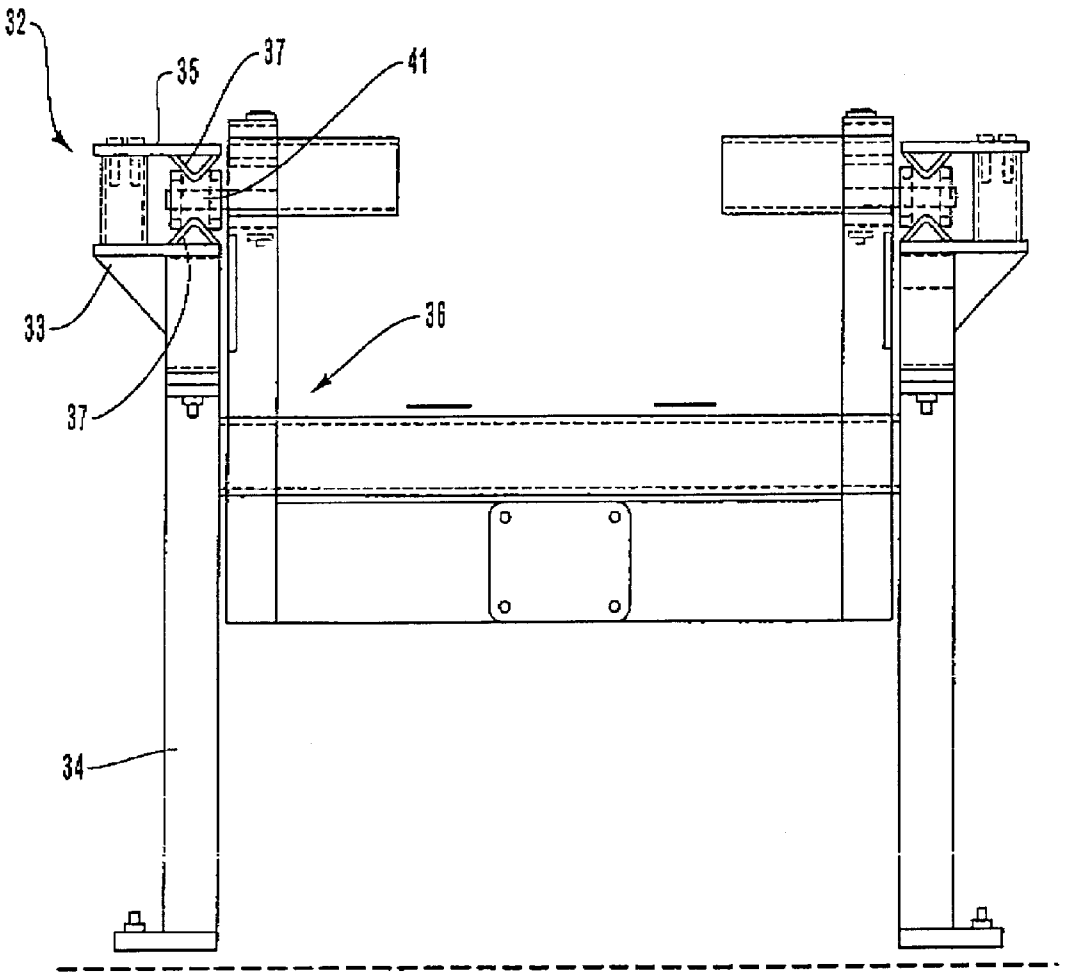
FIG. 2 is an end view of a portion of the pressing assembly shown in FIG. 1

As shown most clearly in FIG. 2, the support frame 32 is comprised of a lower plate 33. Spaced support brackets 35 are secured to the lower support plate 33 at spaced locations there along. Both the lower support plate 33 and the spaced support brackets 35 support respective lengths of angle section 37. The angle sections 37 on each side of the support frame 32 define a space therebetween. The angle sections 37 are oriented with their 90° angles facing away from the space therebetween.

The spaced rails 38 of the slidable carriage 36 each include a number of rollers 41 each having a shape complementary to the space between the angle sections 37. The rollers roll along the lower angle section 37 and are retained in position by the upper angle section 37.

The slidable carriage 36 also includes a pair of first pushers 42 in the form of elongate fingers pivotally attached about a vertical axis to respective rails 38. It will be apparent from the figure that as the carriage 36 is slid towards the press, the fingers 42 act against the tailing side of the object 16 to push the object into the region between the two platens. In this way, the object 16 can be relatively accurately positioned between the two platens and the region between the platens to be occupied by the object is referred to as "the pressing zone". The accurate positioning in the centre of the press ensures that the load through the press columns is balanced for longevity of the press.

As the object 16 is moved into the pressing zone, a subsequent object is moved into the loading zone previously occupied by object 16 in the figure. This subsequent object may be moved into this position by means of a conventional conveyer. In order that the fingers 42 may move past the subsequent object in the loading zone so as not to push it out of the loading zone away from the press, the fingers 42 are pivotable. On reverse motion of the slidable carriage 36 the sides of the fingers 42 will contact the object and be retracted away from the object and towards the respective rails 38 of the carriage 36. In this way, with each forward motion of the carriage 36 an object is moved from the loading zone to the pressing zone between the platens. On each reverse motion of the carriage 36 the fingers 42 retract as they pass the subsequent-object in the loading zone. The fingers 42 are biased to return to the extended configuration illustrated in FIG. 3. Further, a stop is provided to define the extended configuration. It can be seen that in this position, the end face of the fingers 42 extends at 90 degrees to the direction of travel of the carriage 36.

The slidable carriage 36 also includes a pair of second pushers 44. The second pushers 44 are of a similar construction to the first pushers 42 and comprise pivotable fingers which are biased to return to the extended configuration defined by the stop 43. The second fingers 44 perform the function of ejecting an object from the pressing zone of the press 12 with each forward motion of the sliding carriage 36. On rearward motion of the sliding carriage 36, the second fingers 44 are retractable so as to move past the object in the pressing zone with minimal disruption to its positioning.

Proximity switches (not shown) locate the bale correctly at the pressing zone. This forms part of a control system to ensure that the bale is properly located at a central position within the press. Further proximity switches can be used to detect and/or indicate that the slidable carriage has moved out of the region between the two platens 20, 22.

The foregoing describes only one embodiment of the present invention and modifications may be made thereto without departing from the scope of the present invention.

What is claimed is:

1. A pressing assembly comprising:

press for pressing objects; and means for loading objects into and out of the press, wherein the means for loading is operatively connected to the press and comprises a reciprocable pusher assembly moveable in a forward and a reverse direction, the pusher assembly comprising:

a first pusher moveable with the pusher assembly for loading one of said objects to a pressing zone in the press on forward movement of the pusher assembly; and a second pusher moveable with the pusher assembly for ejecting another of said objects from the pressing zone on forward movement of the pusher assembly wherein, in the reverse direction of the pusher assembly, the second pusher is moveable to retract beyond the object loaded into the pressing zone.

2. The pressing assembly as claimed in claim 1 wherein the reciprocal pusher assembly includes a linkage enabling the first and second pushers to move in unison.

3. The pressing assembly as claimed in claim 2 wherein the linkage is a rail.

4. The pressing assembly as claimed in claim 3 wherein the reciprocable pusher assembly is supported by a support frame, and the rail is slidable linearly along the a support frame.

5. The pressing assembly as claimed in claim 4 wherein gliders extend from the reciprocable pusher assembly and the support frame includes a track, the gliders being received within the track.

6. The pressing assembly as claimed in claim 4 wherein one end of the support frame is supported by the press.

7. The pressing assembly as claimed in claim 2 wherein the linkage, with the first and second pushers, is disposed to the side of the path of the objects being loaded into the press.

8. The pressing assembly as claimed in claim 7 wherein there are two linkages disposed on either side of the path of the objects being loaded into the press, each including first and second pushers.

9. The pressing assembly as claimed in claim 8 wherein the two linkages are joined so as to move in unison thereby defining a moveable carriage.

10. The pressing assembly as in claim 9 wherein the carriage is reciprocated by a single reciprocable means for driving.

11. The pressing assembly as claimed in claim 1 wherein the reciprocal pusher assembly is such as to load individual bales sequentially into the press.

12. The pressing assembly as claimed in claim 1 wherein the press comprises opposing platens which close to compress one or more of said objects loaded into the pressing zone within the press and the reciprocable pusher assembly is such that it is clear of the pressing zone during the closing of the platens.

13. The pressing assembly as claimed in claim 12 wherein the reciprocable pusher assembly is completely clear of the region between the platens prior to any closing movement of the press.

14. The pressing assembly as claimed in claim 12 wherein the press operates to initially apply a minimal pressure to the object within the press to thereby hold the object in the pressing zone so as to minimise the possibility of movement when the reciprocable pusher assembly is moved in the reverse direction.

15. The pressing assembly as claimed in claim 12 wherein the reciprocable pusher assembly is operable to move into the space between the opposing platens once the platens have opened sufficiently to enable a subsequent one of said objects to be loaded into the press.

16. The pressing assembly as claimed in claim 12 wherein the reciprocable pusher assembly is operable so as to be completely free of the press until the platens are fully open.

17. The pressing assembly as claimed in claim 1 wherein the or each second pusher is pivotable.

18. The pressing assembly as claimed in claim 1 wherein the or each second pusher is in the form of an elongate finger.

19. The pressing assembly as claimed in claim 1 wherein the or each second pusher is biased by a means for biasing to return to the unretracted configuration.

20. The pressing assembly as claimed in claim 19 providing a plurality of second pushers which are moveable during reverse movement of the pusher assembly to retract out of the pressing zone by simple contact with the object in the pressing zone wherein the means for biasing which bias the second pushers to the unretracted configuration has a net effect of which is less than the force resisting movement of the object from the pressing zone.

21. The pressing assembly as claimed in claim 1 wherein the or each first pusher is operable to move an object from a loading zone to the pressing zone in the forward direction of the pusher assembly with the or each first pusher being retractable in the reverse direction of the pusher assembly to retract beyond a subsequent one of said objects positioned in the loading zone.

22. The pressing assembly as claimed in claim 21 wherein the or each first pusher is biased to return to the unretracted configuration.

23. The pressing assembly as claimed in claim 1 wherein the or each first pusher is pivotable.

24. The pressing assembly as claimed in claim 1 wherein the or each first pusher is in the form of an elongate finger.

25. A method of loading/unloading objects into a press, the method comprising:

moving a reciprocable pusher assembly in a forward direction to simultaneously move both first and second pushers thereof such that the first pusher moves one of said objects to a pressing zone between opposing platens in the press and the second pusher ejects another of said objects from the press; and moving the reciprocable pusher assembly in a reverse direction to simultaneously move both the first and second pushers wherein the second pusher also moves to retract beyond the pressing zone.

26. The method as claimed in claim 25 wherein the reciprocable pusher assembly is movable to slide along a support frame.

27. The method as claimed in claim 25 wherein the reciprocable pusher assembly loads the objects sequentially into the press.

28. The method as claimed in claim 25 wherein the reciprocable pusher assembly is such that it is clear of the pressing zone during closing of the platens.

29. The method as claimed in claim 25 wherein the press operates to initially apply a minimal pressure to the object within the press to thereby hold the object in the pressing zone so as to minimise the possibility of movement when the reciprocable pusher assembly is moved in the reverse direction.

30. The method as claimed in claim 25 wherein the reciprocable pusher assembly is operable to move into the space between the opposing platens once the platens have opened sufficiently to enable a subsequent object to be loaded into the press.

31. The method as claimed in claim 25 wherein the reciprocable pusher assembly is operable so as to be completely free of the press until the platens are fully open.

32. The method as claimed in claim 25 wherein the or each second pusher pivots to retract beyond the pressing zone.

33. The method as claimed in claim 25 wherein the or each second pusher is biased to return to the unretracted configuration.

34. The method as claimed in claim 25 wherein the or each first pusher operates to move an object from a loading zone to the pressing zone in the forward direction of the pusher assembly with the or each first pusher retracting in the reverse direction of the pusher assembly to retract beyond a subsequent object positioned in the loading zone.

35. The method as claimed in claim 25 wherein the press includes one stationary platen and one movable platen, and wherein the base of the object as it is moved by the reciprocable pusher assembly towards the press defines a loading plane, the stationary platen being level with the loading plane.

36. A method of loading objects into a press having two opposing platens, the method comprising:

providing an object to a be pressed; and using a loader comprising one or more first pushers movable within a region between the platens to load the object to a pressing zone within the press whereby the pushers are clear of the pressing zone once the press operates to compress the object; and simultaneously with the loading step, using an ejector comprising one or more second pushers to eject a preceding object from within the press, the second pushers being retractable to move past the object loaded into the press.

37. The method as claimed in claim 36 wherein there are two first pushers arranged to act on opposite sides of the object.

38. The method as claimed in claim 36 wherein the first pushers retract to move past a subsequent object to be loaded.

39. The pressing assembly as claimed in claim 1 further comprising means for detecting accurate placement of the object being loaded at the pressing zone.

40. The method as claimed in claim 25 further comprising using a detector to accurately place the object being loaded at the pressing zone.

* * * * *